US007398786B2

(12) United States Patent
Eichhorn et al.

(10) Patent No.: US 7,398,786 B2
(45) Date of Patent: Jul. 15, 2008

(54) CLEANING DEVICE FOR THE SHAVING HEAD OF A DRY SHAVING APPARATUS

(75) Inventors: Reinhold Eichhorn, Idstein (DE); Detlef Gleich, Friedrichsdorf (DE); Sebastian Hottenrott, Idstein (DE); Peter Junk, Seelenberg (DE); Christof Kleemann, Eschborn (DE); Michael Odemer, Niddatal-Assenheim (DE); Thorsten Pohl, Mühlheim (DE); Tobias Schwarz, Schmitten (DE); Jürgen Wolf, Kriftel (DE)

(73) Assignee: Braun GmbH, Kronberg (DE)

( * ) Notice: Subject to any disclaimer, the term of this patent is extended or adjusted under 35 U.S.C. 154(b) by 569 days.

(21) Appl. No.: 11/168,958

(22) Filed: Jun. 28, 2005

(65) Prior Publication Data

US 2006/0021638 A1 Feb. 2, 2006

(30) Foreign Application Priority Data

Jul. 6, 2004 (DE) ..... 10 2004 032 518

(51) Int. Cl.
*B08B 3/00* (2006.01)
*B08B 6/00* (2006.01)

(52) U.S. Cl. ..... 134/46; 134/44; 134/105; 134/11; 134/186

(58) Field of Classification Search ..... 134/44, 134/46, 104.4, 105, 110, 111, 135, 186; 30/41, 30/41.5

See application file for complete search history.

(56) References Cited

U.S. PATENT DOCUMENTS 2,447,183 A * 8/1948 Irish et al. ..... 312/31.01
5,614,030 A * 3/1997 Braun ..... 134/22.1
5,649,556 A * 7/1997 Braun ..... 134/92
5,711,328 A 1/1998 Braun
6,263,890 B1 * 7/2001 Hoser ..... 134/111
6,305,391 B1 * 10/2001 Hoser ..... 134/111
6,626,194 B2 * 9/2003 Wong ..... 134/102.2
6,698,437 B2 * 3/2004 Hoser et al. ..... 134/104.4
7,002,091 B2 * 2/2006 Hoser et al. ..... 200/520
7,143,517 B2 * 12/2006 Kappes et al. ..... 30/538
7,225,817 B2 * 6/2007 Eichhorn et al. ..... 134/105

FOREIGN PATENT DOCUMENTS

DE 102 09 326 6/2003
EP 0 664 973 7/1999
WO WO03/073885 9/2003

OTHER PUBLICATIONS

Syncro System, Smart Logic Owners Manual; Braun GmbH; prior to Jun. 28, 2004.

* cited by examiner

*Primary Examiner*—Michael Barr
*Assistant Examiner*—Rita R Patel
(74) *Attorney, Agent, or Firm*—Fish & Richardson P.C.

(57) ABSTRACT

A cleaning device for the shaving head of a dry shaving apparatus includes a receptacle formed in a housing of the cleaning device. The receptacle adapted to receive the shaving head for cleaning with a cleaning fluid. During the cleaning cycle, the dry shaving apparatus is lockable in the cleaning device by means of an interlock. The shaving head is exposed to heat from a heater for drying subsequent to cleaning. Following a drying cycle, release of the interlock is controlled by a control element provided in the cleaning device to prevent an operator's skin from being burned by an excessively hot shaving head in an immediately succeeding shaving operation.

16 Claims, 3 Drawing Sheets

CLEANING DEVICE FOR THE SHAVING HEAD OF A DRY SHAVING APPARATUS

TECHNICAL FIELD

This invention relates to a cleaning device for the shaving head of a dry shaving apparatus.

BACKGROUND

During a cleaning cycle, a cleaning device for electric-powered dry shaving apparatus can hold the dry shaving apparatus by means of an interlock device. The dry shaving apparatus cannot be removed until the interlock device is released and the electrical contact elements engaging the bottom end of the shaver housing are retracted from the housing. A fan driven by an electric motor can be used to dry the shaving head with an air stream being passed around the shaving head carried in the receptacle and drying the latter from both the outside and the inside.

Induction heaters can be used for heating the metal parts in the shaving head, e.g. the shaving foil and the undercutter. In this manner, the heated metal parts can heat the cleaning fluid during a cleaning cycle in addition to being able to dry the shaving head rapidly after the cleaning cycle. With a corresponding temperature increase of the metal parts in particular, it is also possible to produce sterile conditions without the evaporation of cleaning fluid.

SUMMARY

In one aspect, a cleaning device includes a control element responsive to the temperature of the shaving head and controlling an interlock device in dependence upon temperature. By virtue of the fact that the interlock device does not release the shaving apparatus for its removal from the cleaning device until a temperature suitable for shaving prevails on the metal shaving foil, skin burns are avoided when a shaving operation follows immediately afterwards. The control element may act on the interlock device directly or, alternatively, the control element may act on the interlock device mechanically, electrically or even hydraulically.

In this context it will be understood that a dry shaving apparatus also includes also electric-powered shaving apparatus that enable a shave to be performed also under water or a lotion to be supplied during a shave for improved shaving performance or enhanced operator comfort. Preferably, the shaving apparatus is equipped with outer cutter and undercutter sliding relative to each other, whether in a toothed configuration of both cutters or in a configuration involving a foil cooperating with an undercutter, and is powered electrically.

In some embodiments, a temperature-sensitive control element is exposed to the heat from the heater. The temperature-sensitive element is designed and spaced at a distance from the heater such that the interlock device is maintained in a locked condition as long as the temperature on the shaving head and, hence, on the shaving foil, is too high for contact with the skin. It will be understood that it would also be possible for the temperature-sensitive element to be arranged in the vicinity of the shaving head and to sense the temperature directly on the shaving head. An induction heater has proven to be advantageous because it is located underneath the receptacle, its magnetic fields penetrating the receptacle and the cleaning fluid held in the receptacle, thus reaching the metal parts in the shaving head and heating them. In this manner, the heater winding is protected from contact with liquid, thus increasing its service life.

A metal spring made from a memory metal has proven advantageous as a component that expands and contracts to a sufficient degree to serve as the temperature-sensitive control element as well as affording ease and economy of manufacture. However, the use of a bimetal in lieu of the memory metal is also contemplated. The spring may be either a leaf spring, a spiral spring or an otherwise bent sheet-metal element which expands or bends a particularly appreciable amount due to the effect of temperature. When such a temperature-sensitive element is heated and, hence, expands correspondingly, its expansion force can be introduced mechanically to a locking element to enable the locking element to engage with a recess, undercut, projection or some other engagement part formed on the dry shaving apparatus to lock the shaving apparatus into the cleaning device.

In some embodiments, the locking element can be configured to return to its initial position automatically. For example, when the heater has been on for a certain period of time, the temperature-sensitive element expands due to heat radiation and/or heat conduction—the latter only if contact exists between the locking element and the heater—and/or due to the heat developing in metal parts as the result of induced eddy currents, urging the locking element into engagement with a recess, projection or undercut of the dry shaving apparatus. At the same time, displacement of the locking element compresses a spring whose spring force is smaller than the force developed by expansion of the temperature-sensitive element. On cooling down, the temperature-sensitive element contracts again, its force diminishing. This enables the spring to disengage the locking element from its engagement with the recess, projection, or undercut. As this occurs, the locking element releases the dry shaving apparatus for removal. In this manner, an automatic locking device is obtained which, without operator intervention, locks the shaving apparatus in the cleaning device when the temperature on the shaving head is too high, and releases it again when the temperature on the shaving head has dropped to a sufficiently low value, preferably below 40° C.

In another embodiment, a manually actuatable actuating element which, when hand-operated by an operator, causes the locking element to be moved to its locking position when the cleaning device is turned on, is connected upstream of the control element. At the locking element is engaged, the electric control device of the cleaning device is activated to commence a cleaning cycle. Because the actuating element cannot be returned to its initial position until the temperature-sensitive element releases the shaving apparatus, the returning of the actuating element takes place likewise without operator intervention. In this embodiment, a vertical motion of the actuating element is converted into a horizontal motion of the locking element, which is accomplished by suitably arranged guide rails and a ramp, the latter cooperating in gliding fashion with a pin formed on the actuating element. It will be understood that other motion-converting mechanism using other transmission angles between the actuating element and the locking element may be employed.

In some embodiments, a mechanical switching device between the housing and the actuating element uses a cardioid slide arrangement which operates the electric switch of the cleaning device on actuation and subsequent release of the actuating element. Renewed actuation and release of the actuating element returns the slide arrangement to its initial position. Such an On-Off mechanism is particularly simple in terms of function and affords economy of manufacture. The switching mechanism can also provide a clearance space for movement of the temperature-sensitive element to enable it to initially expand freely due to the effect of temperature.

In some embodiments, a time-dependent control element (e.g. electronic or mechanical timers), upon termination of a cleaning cycle, moves the locking element from its locking position back to its initial position as a function of time. Only after a specified time period has elapsed can the dry shaving apparatus be removed from its receptacle. The cooling-off period upon termination of a cleaning cycle is selected to last until the temperature on the shaving head drops below a value limiting the risk of burns when the shaving foil subsequently contacts an operator's skin.

When a mechanical timer is used, it can be turned on with the commencement of a cleaning cycle, because the duration of a cleaning cycle is exactly known. Therefore, this time period plus a cooling period can be entered in the timer as the specified time period. The dry shaving apparatus is then released only when the temperature on the shaving head is likely to be sufficiently low. In embodiments where an electronic timer is used, preferably an electrically actuatable control element which is locked or unlocked electronically by the timer control signal is also used.

In some embodiments, an electric temperature sensor is arranged in the vicinity of the heater. In such embodiments, which however incur slightly higher cost, the electric temperature sensor may directly sense the surface of the shaving head. For example, water-protected temperature sensors can be used that have their electrical signals supplied to a control circuit via lines, said control circuit in turn operating in response to the temperature to release or lock the locking element via electromechanical devices as, for example, an electric solenoid switch.

The details of two embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
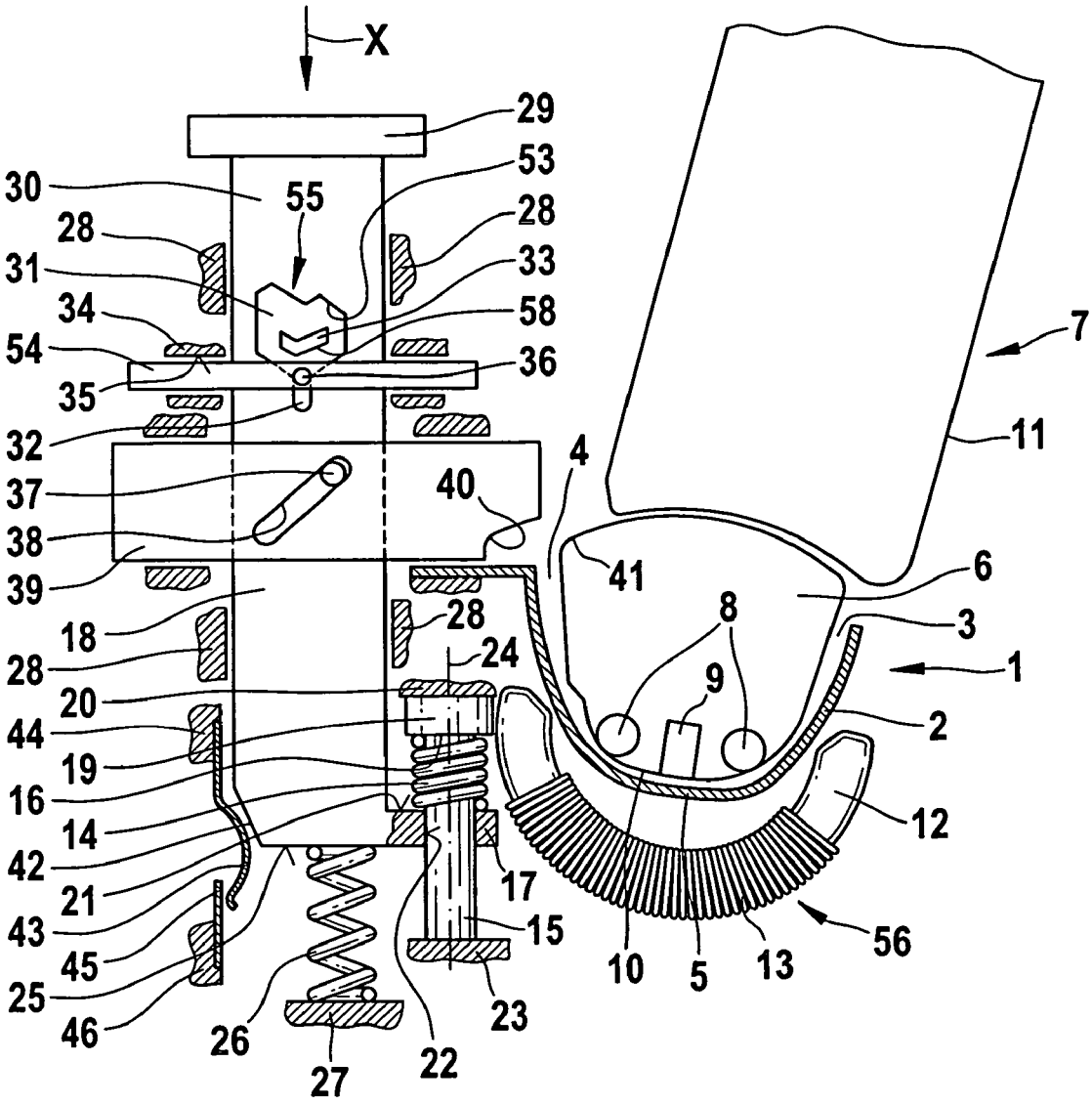
FIG. 1 is a schematic of an interlock and switch-on device as integrated in a cleaning device for a dry shaving apparatus, in unlocked condition, in which a dry shaving apparatus, of which only a fragment is shown, is inserted in a receptacle of the cleaning device for cleaning purposes.

Referring now to FIGS. 1 to 4, an electric-powered cleaning device I is comprised of a receptacle 2 having a bowl-shaped receiving space 3 for accommodating a shaving head 6 and a cleaning fluid (not shown). The receiving space 3 is open in upward direction by means of the opening 4. Directional references in this description are provided with reference to the orientation of the drawings rather than to imply an absolute orientation of the components described. The shaving head 6 of a dry shaving apparatus 7 extends through the opening 4 down to the bottom 5. The shaving head 6 preferably includes two undercutters 8 and one long-hair trimmer 9 provided intermediate the undercutters 8. The undercutters 8 are covered toward the outside by a shaving foil 10 to form the short-hair cutter unit. The shaving head 6 is pivotally mounted on the housing 11 (shown only in part) of the dry shaving apparatus 7. Mounted in the housing 11 are a drive mechanism, an electronic switching device, storage batteries and other components, which are not shown in the drawings.

Underneath the receptacle, a coil 13 is wound around an iron core 12 and generates a magnetic field when electric current is passed through the coil. The magnetic field serves to heat the metal parts 8, 9, 10 as well as the entire shaving head 6 and the cleaning fluid (not shown) that is temporarily present in the receiving space 3 during a cleaning cycle. The iron core 12 and the coil 13 form the heater 56 of the cleaning device 1. Arranged on the left side of the receptacle 2 at the level of the left-hand free end of the U-shaped and upwardly open iron core 12 is a control element 14 which, in this embodiment, is a spiral spring made from memory metal. The control element 14 is formed by a temperature-sensitive element through which a stud 15 extends.

Figure 2:
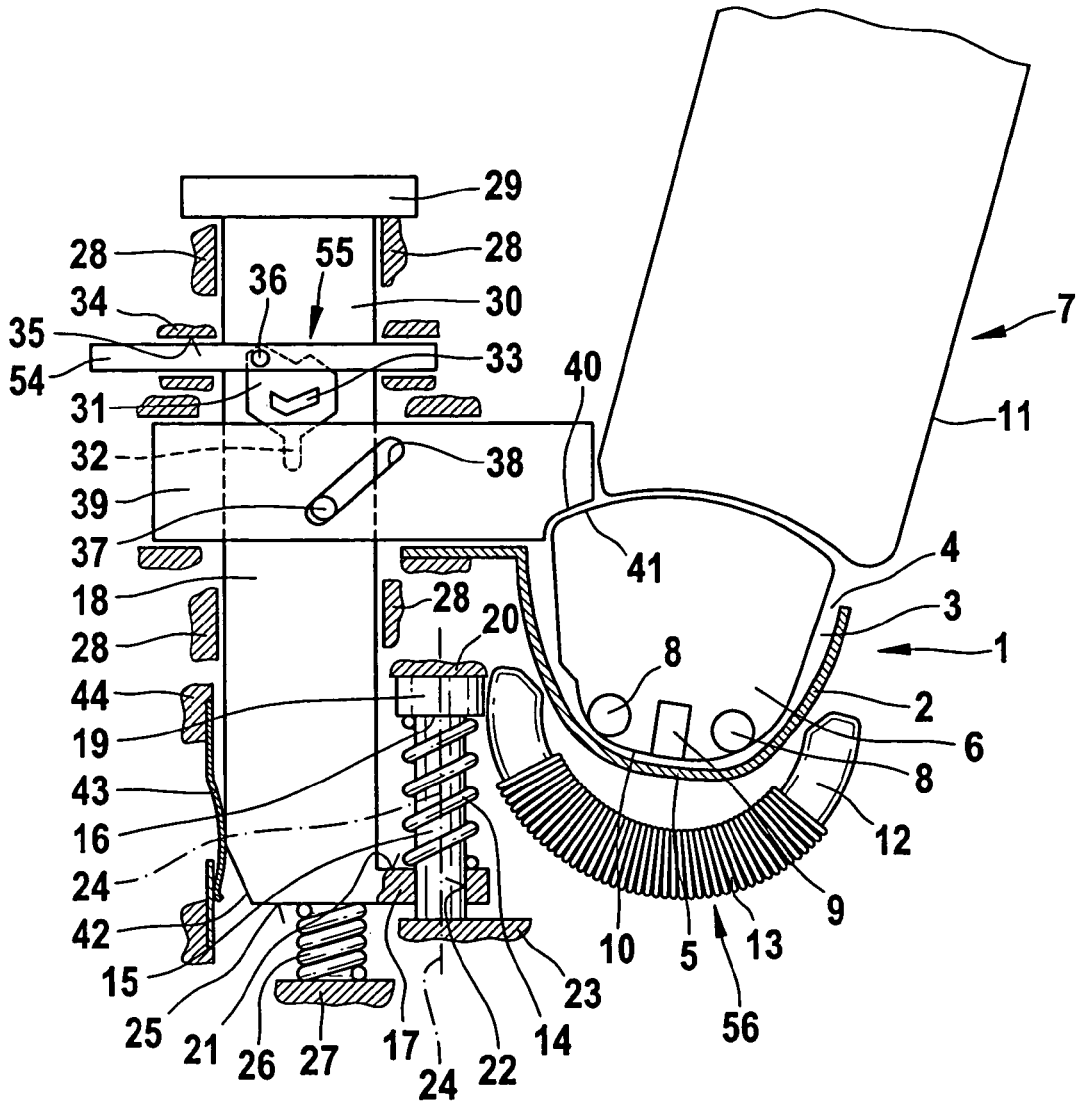
FIG. 2 is a view similar to FIG. 1 but showing the interlock and switch-on device in locked condition.

Referring to FIGS. 1 and 2, the stud 15 widens in the form of a step 16, forming an upper enlarged section 19 that is fixedly connected to a housing part 20 of the cleaning device 1. The temperature-sensitive element 14 bears with its other end against an end surface 21 of an arm 17 formed integrally with an actuating element 18. At the same time, the stud 15 extends through a bore 22 formed in the arm 17. The arm 17 is shown cut away for better clarity of illustration of the bore 22. The stud 15 passes through the bore 22 and projects beyond the arm 17 downwardly, its other end being likewise fixed to a component 23 of the cleaning device 1 formed fast with the housing. In this manner, the actuating element 18 has its lower region guided in the longitudinal direction of the vertical axis 24 of the stud 15. The temperature-sensitive element 14 is thus solidly seated between the step 16 and the end surface 21.

Referring to FIGS. 1 and 2, a compression spring 26 in the form of a spiral spring bears with one end against the lower outer end surface 25 formed in the transition region between the lower free end of the arm 17 and the actuating element 18, while its other end rests against a stop 27 formed fast with the housing. The actuating element 18 is constructed as an essentially rectangular flat injection molded part guided in an up and down direction parallel to the vertical axis 24 in lateral guides 28 formed fast with the housing. Provided on the upper free end of the actuating element 18 is a shoulder 29 forming the control button.

Arranged on the front surface 30 of the actuating element 18 of FIGS. 1 and 2 is a heart-shaped recess 31 having an adjoining central slot 32 in the lower region thereof. Extending centrally in the recess 31 at a slight upward inclination from left to right is a rib 33. On another housing part 34, a horizontally displaceable sliding block having a pin 36 fastened to it is guided in a groove 35, said pin cooperating with the recess 31 to form a two-position mechanical switching device 55.

Referring to FIGS. 1 and 2, underneath actuating device 36, a pin 37 engaging a ramp 38 extending from bottom to top right is fastened to the actuating element 18. The ramp is part of a locking element 39 shaped in an essentially rectangular configuration and having at its bottom right end a recess 40 which in the locked position of the dry shaving apparatus 7 shown in FIG. 2 engages behind the lower left edge 41 of the shaving head 6 from above.

Referring to FIGS. 1 and 2, the lower left end of the actuating element 18 has a bevel 42 opposite to which is a bent sheet-metal blade 43 that is fixed to a stop 44 formed fast with the housing. Fixed to a lower stop 46 formed fast with the housing is a second sheet-metal blade 45 level with the first blade 43. The two sheet-metal blades are spaced from each other by a small distance, being brought together by the bevel 42 and hence making contact on displacement of the actuating element 18 in the On-direction (X).

Figure 3:
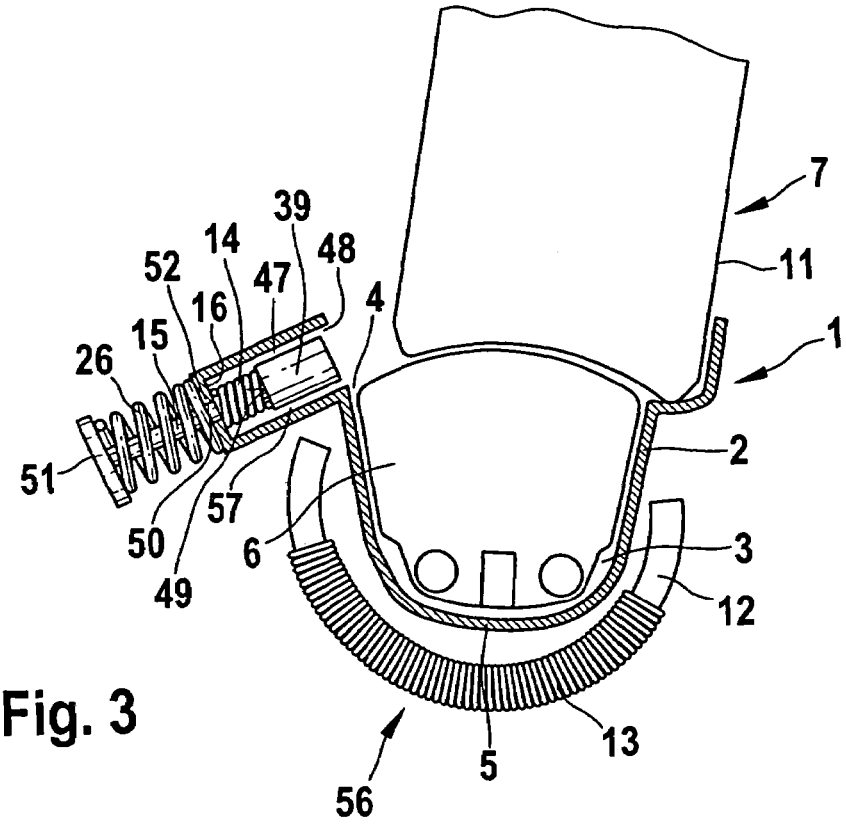
FIG. 3 is a sketch of an interlock device in accordance with a second embodiment as integrated in a cleaning device for a dry shaving apparatus, in unlocked condition, in which a dry shaving apparatus, of which only a fragment is shown, is inserted in a receptacle of the cleaning device for cleaning purposes.
Figure 4:
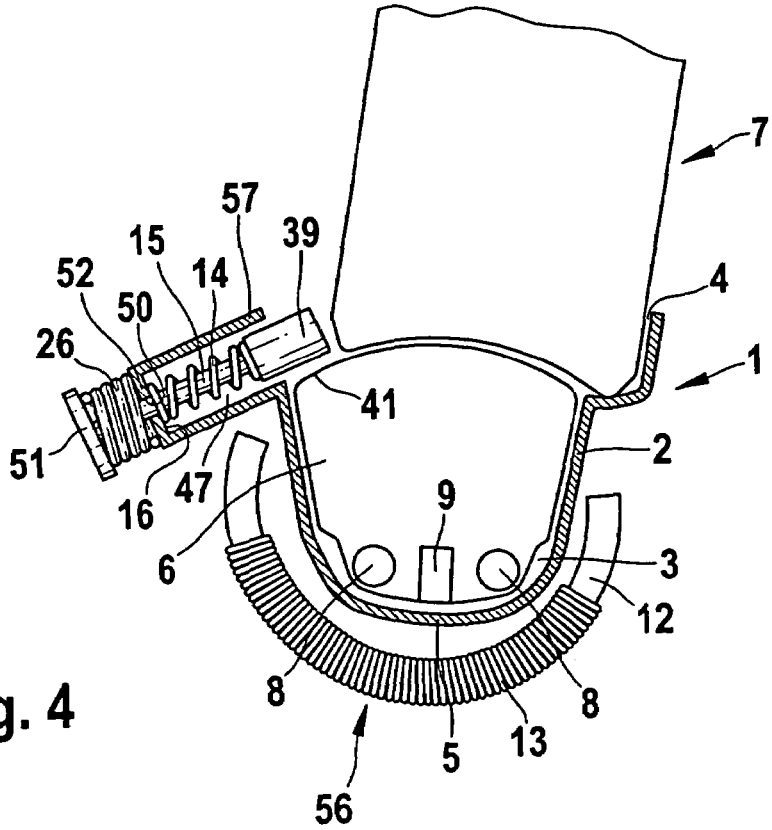
FIG. 4 is a view similar to FIG. 3 but showing the interlock device in locked condition.

An actuating element 18 as represented in FIGS. 1 and 2 is not shown in FIGS. 3 and 4 for the sake of simplicity. Adjoining the upper left section of the receptacle 2 is a cup-shaped receiving socket 57 having a cylindrical recess 47 in which the temperature-sensitive element 14 is located. Towards the other side, the recess 47 is open by means of the opening 48 to enable the locking element to exit from the opening 48. The step 49 formed on the locking element 39 provides the stop for the one end of the temperature-sensitive element 14. On its other end, the temperature-sensitive element 14 bears against an end surface 16 formed on the bottom 52 of the receiving socket 57. The bottom 52 has a central bore 50 that extends concentrically with the temperature-sensitive element 14. The stud 15 connected to the locking element penetrates the bottom 52 through the bore 50, terminating at an enlarged abutment stop 51. Seated between the abutment stop 51 and the bottom 52, the compression spring 26 bears against the receiving socket 57 from outside.

Referring to FIGS. 1 and 2, the mode of operation of the cleaning device 1 of the invention is as follows:

After the dry shaving apparatus 7 is inserted into the receiving space 3 of the receptacle 2 with its shaving head 6 pointing down, the control button 29 is pressed down by hand in the direction X to activate the cleaning device 1. As this occurs, the actuating element 18 moves downwards in the vertical guide 28, whereby the locking pin 36 slides along the underside 58 of the rib 33 upwards and enters the upper section of the recess 31 where it is moved along the upper wall 53 to the left inside the groove 35.

At the same time, axial displacement of the actuating element 18 in the direction X causes displacement of the locking bar 39 by means of the pin-and-ramp guide 37, 38 to the right, so that the recess 40 engages behind the edge 41 of the shaving head 6 from above. On displacement of the actuating element 18, the sheet-metal blade 43 is elastically bent to the left by means of the bevel 42 until its free end contacts the sheet-metal blade 45, whereby electric current is supplied to the cleaning device enabling the cleaning cycle to be started. Displacement of the actuating element 18 simultaneously compresses the spring 26. The temperature-sensitive element 14 retains the contracted position as shown in FIG. 1, so that the downward movement of the actuating element 18 produces a clearance space between the step 16 and the upper free end of the temperature-sensitive element, which however is not shown in FIG. 2 of the drawings because there the spring is already expanded due to the effect of the temperature of the heater 12, 13. After the control button 29 is released, the locking pin 36 abuts against the upper left wall 53 of the heart-shaped recess 31, holding the actuating element 18 in the On-position shown in FIG. 2.

As soon as electric current is supplied to the heater 56, a magnetic field is produced on the coil 13 and the iron core 12, causing heating of the metal parts lying in the vicinity of the heater 56, which include the shaving foil 10 and the metal parts provided in the interior of the shaving head 6, the temperature-sensitive element 14 and the stud 15. The temperature-sensitive element 14 expands in the process until its upper free end abuts against the step 16. Continued expansion of the temperature-sensitive element 14 compresses it because a further longitudinal expansion is not possible due to the spring 26 having previously been compressed to its solid length. This position is now maintained for the duration of the On-state of the cleaning device 1.

If an attempt is made to remove the dry shaving apparatus 7 from the cleaning device 1 during or directly subsequent to a cleaning cycle, this is not possible because the locking element 39 holds the shaver captive in the receptacle 2 due to the still expanded temperature-sensitive element 14. Even if an attempt is made to move the actuating element 18 back to its initial position shown in FIG. 1 by depressing the control button 29 in the direction X, removal is not possible, because the force of expansion of the temperature-sensitive element 14 is greater than the force of the spring 26 due to the heat. This means that the force of the temperature-sensitive element 14, which acts downwards onto the actuating element 18, is greater than the force of the spring 26 acting upwards onto the actuating element 18. Hence, the actuating element 18 is prevented from moving upwards into the initial position of shown in FIG. 1.

With the temperature-sensitive element 14 cooling off slowly, its force diminishes and the force of the spring 26 predominates, compressing the temperature-sensitive element 14 and urging the actuating element 18 upwards in opposition to the On-direction X. As this occurs, the locking pin 36 slides on the left side downwards past the rib 33 to resume the lower initial position illustrated in FIG. 1. At the same time, the movement of the actuating element 18 in opposition to the direction X causes displacement of the locking element 39 to the left by means of the pin-and-ramp arrangement 37, 38, and the dry shaving apparatus 7 is released for removal from the receptacle 2.

The mode of operation of the embodiment of FIGS. 3 and 4 is similar to the embodiment of FIGS. 1 and 2 so that only the differences will be discussed. A significant difference from the embodiment of FIG. 1 is that control of the locking element 39 is exclusively by the temperature-sensitive element 14 and the spring 26. In the presence of an excessive temperature on the shaving head 6, the temperature-sensitive element 14 of FIG. 4 is expanded and moves the locking element 39 in opposition to the force of the spring 26 out of the recess 47 until it engages behind the edge 41 of the shaving head 6 from above. This engagement prevents the dry shaving apparatus 7 from being removed from the receptacle 2.

Also in this embodiment, induction or heat radiation from another source of heat causes heating of the metal parts in the shaving head 6 as well as the locking element 39 and the stud 15 connected therewith and the abutment stop 51, provided they are also made from metal. When the heater 56 cools off after a cleaning cycle, the temperature-sensitive element 14 also cools and retracts into the position shown in FIG. 3. This enables the spring 26 to bias, through the abutment stop 51, the stud 15 together with the locking element 39 back into the recess 47. This releases the edge 41 of the shaving head 6 and the dry shaving apparatus 7 is ready for removal from the receptacle 2 and hence from the cleaning device 1. The temperature-sensitive element is configured such that this occurs when the shaving foil 10 has reached a temperature that will not cause burns if placed in contact with a user's skin.

A number of embodiments of the invention have been described. Nevertheless, it will be understood that various modifications may be made without departing from the spirit and scope of the invention. For example, the control element 14 can be a time-dependent element rather than a temperature-dependent element. Accordingly, other embodiments are within the scope of the following claims.

What is claimed is:

1. A cleaner for a shaving head of a dry shaving apparatus adapted to be cleaned with a cleaning fluid, the cleaner comprising:

a housing forming a receptacle sized to receive the shaving head;

an interlock that locks the dry shaving apparatus in the cleaner during a cleaning cycle, the interlock having a locked position and an unlocked position;

a heater arranged to heat the shaving head during a drying cycle subsequent to the cleaning cycle; and a control element configured to release the interlock following the drying cycle, wherein the control element comprises a temperature-sensitive element exposed to heat from the heater.

2. The cleaner as claimed in claim 1, wherein the temperature-sensitive element comprises a first spring made from memory metal.

3. The cleaner as claimed in claim 2, wherein the interlock comprises a displaceable locking element cooperating with the temperature-sensitive element in such fashion that the locking element is capable of engaging the shaving apparatus on expansion of the temperature-sensitive element due to the effect of heat from the heater.

4. The cleaner as claimed in claim 2, further comprising a second spring, the first spring capable of applying a first force to the interlock and the second spring capable of applying a second force to the interlock, wherein when a temperature of the first spring is above a predetermined temperature, the first force exceeds the second force such that a sum of the first and second forces biases the interlock towards its locked position, and, when the temperature of the first spring is below the predetermined temperature, the second force exceeds the first force such that the sum of the first and second forces biases the interlock towards its unlocked position.

5. The cleaner as claimed in claim 2, wherein the interlock comprises a ramp that engages a pin, the pin and the ramp arranged to convert longitudinal motion of a manually actuatable actuator to transverse motion of the interlock.

6. The cleaner as claimed in claim 5, further comprising a spring wherein the temperature-sensitive element is capable of acting on the actuator in a first direction while the spring is capable of acting on the actuator in opposition to the first direction.

7. The cleaner of claim 6 wherein the temperature-sensitive element is capable of exerting a first force, in response to temperatures above a predetermined temperature, that exceeds a second force exerted by the spring such that the interlock is held in a locked position.

8. The cleaner as claimed in claim 5, further comprising a mechanical switch having a first state and a second state located between the actuator and the housing, the switch arranged such that actuation of the actuator transitions the switch from one state to the other.

9. The cleaner as claimed in claim 2, wherein the temperature-sensitive element is an electronic temperature sensor adapted to emit signals to an electronic control circuit that evaluates the signals, the electronic control circuit capable of passing corresponding signals on to an electronically actuatable interlock when the temperature on the shaving head is below a predetermined temperature.

10. The cleaner as claimed in claim 1, wherein the control element is a time-dependent element capable of releasing the interlock with a time delay after the heater is turned off.

11. A shaving head cleaner, the cleaner comprising:

a housing forming a receptacle sized to receive a shaving head of an electric shaver;

a heater arranged to heat a shaving head received in the receptacle;

a lock having a first position in which the lock is capable of retaining an electric shaver with its shaving head in the receptacle, and a second position in which the lock releases a retained shaver; and a controller capable of moving the lock from its first position to its second position, wherein the controller comprises a temperature-sensitive element.

12. The cleaner as claimed in claim 11, wherein the temperature-sensitive element comprises a memory metal.

13. The cleaner as claimed in claim 12, wherein the lock cooperates with the temperature-sensitive element such that the lock switches from its second position to its first position in response to heat-induced reconfiguration of the memory metal.

14. The cleaner as claimed in claim 11 wherein the controller comprises a first spring that includes a memory metal and a second spring, the second spring biasing the lock towards its second position and the first spring capable of expanding in response to heat to bias the lock towards its first position.

15. The cleaner as claimed in claim 11, wherein the controller comprises an electronic temperature sensor adapted to emit signals, and an electronic control circuit that receives the signals, and, in response to receiving the signals, actuating the lock.

16. The cleaner as claimed in claim 11, wherein the controller is adapted to release the lock a predetermined delay time after the heater is turned off.

* * * * *